US005497610A

United States Patent [19]

Rottmayr

[11] Patent Number: 5,497,610

[45] Date of Patent: Mar. 12, 1996

[54] PROCESS AND DEVICE FOR PNEUMATIC FEEDING OF FIBERS TO THE FIBER COLLECTION SURFACE OF AN OPEN-END SPINNING ELEMENT

[75] Inventor: Johann Rottmayr, Reutlingen, Germany

[73] Assignee: Rieter Ingolstadt Spinnereimaschinenbau AG, Ingolstadt, Germany

[21] Appl. No.: 332,257

[22] Filed: Oct. 31, 1994

[30] Foreign Application Priority Data

Dec. 4, 1993 [DE] Germany ..... 43 41 411.7

[51] Int. Cl.[6] ..... D01H 4/36; D01H 4/38

[52] U.S. Cl. ..... 57/408; 19/112; 57/406; 57/407; 57/409; 57/410; 57/411

[58] Field of Search ..... 57/301, 406, 407, 57/408, 409, 410, 411; 19/112, 114

[56] References Cited

U.S. PATENT DOCUMENTS

| | | | |
|---|---|---|---|
| 3,626,681 | 12/1971 | Naruse . | |
| 3,681,907 | 8/1972 | Jindra et al. | 57/411 |
| 3,800,520 | 4/1974 | Schiltknecht | 57/411 |
| 3,922,839 | 12/1975 | Sakurai et al. | 57/301 |
| 3,934,145 | 9/1976 | Ellingham et al. | 57/411 |
| 4,901,519 | 2/1990 | Wassenhoven et al. | 57/411 |
| 4,976,099 | 12/1990 | Brockmanns et al. . | |
| 5,361,574 | 11/1994 | Gebhardt | 57/408 |
| 5,373,690 | 12/1994 | Gebhardt | 57/408 |
| 5,398,494 | 3/1995 | Wassenhoven et al. | 57/406 |

*Primary Examiner*—William Stryjewski
*Attorney, Agent, or Firm*—Dority & Manning

[57] ABSTRACT

In pneumatic feeding of fibers (20) to the fiber collection surface of an open-end spinning element, the air which circles together with the opener roller (10) and is conveyed past the inlet opening (40) of the fiber feeding channel (4) is fed back to the fiber feeding channel (4). In this process, the air is conveyed in the circumferential area of the housing (1) between the inlet opening (40) of the fiber feeding channel (4) and the feeding point (21) of the fiber sliver (2) to the opener roller (10) to at least one end of the opener roller (10) and is then fed back along this (at least one) end of the opener roller (10) to the inlet area of the fiber feeding channel (4). Here the air duct, by comparison with the distance between the end wall of the opener roller (10) and the end wall of the housing (1) facing it in the area which does not serve as air duct as seen in the direction of fiber conveying - is designed as an enlargement of the distance between these end walls between the opening (13) containing the feeding device (3) at least in part and the inlet opening (40) of the fiber feeding channel. It extends from the opening (13) containing the feeding device (3) at least in part to the area of the inlet opening (40) of the fiber feeding channel (4).

17 Claims, 4 Drawing Sheets

PROCESS AND DEVICE FOR PNEUMATIC FEEDING OF FIBERS TO THE FIBER COLLECTION SURFACE OF AN OPEN-END SPINNING ELEMENT

BACKGROUND OF THE INVENTION

The instant invention relates to a process for pneumatic feeding of fibers to the fiber collection surface of an open-end spinning element in which a fiber sliver is opened into individual fibers by an opener roller located in a housing, the individual fibers being fed through a fiber feeding channel to the open-end spinning element to be spun, whereby the air circling with the opener roller having been conveyed past the inlet opening of the fiber feeding channel and is fed back to the fiber feeding channel, as well as to a device to carry out this process.

A known method consists in providing the outlet of a channel letting out into the fiber feeding channel between the inlet opening and the spinning element, as seen in the direction of rotation of the opener roller, between the inlet opening into the fiber feeding channel and an opening in the circumferential wall of the opener roller housing which contains the feeding device (DE 39 10 292 A1). This is to prevent clogging of the opener roller and thereby impairing of the opening process. This device is very expensive and is difficult to produce. Changes for adaptation to different conditions cannot be readily carried out with this device.

OBJECTS AND SUMMARY OF THE INVENTION

It is a principal object of the instant invention to create a process and a device by means of which fly formation in proximity of the opening containing the feeding device can be avoided in a simple and energy-saving manner. Additional objects and advantages of the invention are set forth in part in the following description, or may be obvious from the description, or may be learned through practice of the invention.

The objects are attained by the invention in a device of this type in that the air circling with the opener roller is conveyed in the circumferential area of the housing between the inlet into the fiber feeding channel and the feeding point of the fiber sliver to the opener roller to at least one front end of the opener roller and is then fed back along at least one front side of the opener roller to the inlet area of the fiber feeding channel. This prevents the air circling with the opener roller, and which is prevented from further circling by the fiber tuft (leading end of the fiber sliver being fed to the opening roller) which forms a kind of "curtain", from emerging through an opening which contains the feeding device at least in part and thus cause fly clogging of the feeding device and its vicinity, but causes it to be conveyed past the front wall or walls of the opening roller to the fiber feeding channel. In this process, the fibers which were conveyed previously over the inlet opening of the fiber feeding channel are fed again to the inlet opening of said fiber feeding channel.

Preferably the air stream is brought into proximity of the opener roller, in which the opener roller and the fedback air stream have a common movement component, as it is fed back to the inlet area of the fiber feeding channel.

To carry out the process, the invention provides for the air duct - compared with the interval between the end wall of the opener roller and its facing end wall of the housing (as seen in the fiber conveying direction) between the opening which contains the feeding device at least in part and the inlet opening of the fiber feeding channel in the area which does not serve as the air duct - to be in the form of an enlargement of the interval between these end walls and the air duct extending from the opening containing the feeding device at least in part to the area of the inlet opening of the fiber feeding channel.

To ensure in a simple manner that no fibers can settle in the area of the opener roller bearing, the air duct is formed advantageously exclusively in the removable part of the housing.

It has been shown to be advantageous to provide a delimitation wall for the air duct which gradually verge into the area of the end wall of the housing which is not used as air duct.

To ensure that the air need overcome as little flow resistances as possible, the air duct is delimited by a delimiting wall in another advantageous embodiment of the device according to the invention, said delimiting wall being concave (in relation to the axis of the opener roller) and being located on the side of the end wall of the housing which serves as air duct.

To ensure that the air circling together with the opener roller is fed back through the air duct to the inlet opening of the fiber feeding channel before it is able to exert a harmful effect in the area of the opening which containing the feeding device at least in part - through escape to the outside, with corresponding fly clogging this or the adjoining area or through the action of a leading end on the fiber sliver which forms a fiber tuft - provisions are made in an advantageous embodiment of the device according to the invention for the air duct to be delimited by a delimiting wall whose end towards the opening which contains the feeding device at least in part (as seen in the direction of fiber conveying) is located in the area before the feeding point of the fiber sliver.

The air to be returned to the fiber feeding channel must go from the circumference of the opener roller into the area of its end wall. In order to oppose as little resistance as possible to the air in this process, it is advantageous to provide for the opener roller to be equipped with a ring-shaped transition surface between its circumference and its end wall, said transition surface being located neither in this circumference nor in the plane going through the end wall. A convexly cambered ring surface has proven to be especially advantageous for this.

To give the air sufficient time to reach the interval between the end walls of opener roller and housing, it is advantageous for the air duct to verge directly into the space surrounding the circumferential surface of the opener roller on its side away from the area not used as air duct, without having to overcome increased resistances here due to a reduction of the interval provided at this location.

When fibers are forced into the lateral area of the opener roller by the design as described here, the danger exists that the fibers may become jammed between the circumferential wall of the housing and its removable part, the lid. To make this impossible, provisions are made in another advantageous embodiment of the object of the invention that the removable part of the housing is pressed sealingly against the end wall of the housing which adjoins the circumferential wall of the housing towards the opener roller. Such a design of an opener roller housing is of general significance, even in housings in which no backfeeding of air to the fiber feeding channel is provided.

In an especially advantageous embodiment of the object of the invention provisions are made for the removable part of the housing to be provided with a ring-shaped recess, the ring-shaped radial surface of which is designed as a sealing contact surface for interaction with the end wall of the housing which adjoins the circumferential wall of the housing towards the opener roller and whose radial ring surface located outside this end wall and surrounding a circumferential surface of the housing is designed as a centering surface, while the ring surface of the recess following the radial surface of the recess in a radial inward direction forms a gap with the circumferential wall of the housing, the width of which is a multiple of the cross-section of the fibers to be spun. In this manner no fibers can settle in the appropriately wide gap between the removable portion of the housing and the housing itself. A gap width from 0.2 to 0.3 mm has proven to be advantageous.

Whether or not an air duct going to the fiber feeding channel is provided, it is advantageous for the circumferential wall of the housing towards the opener roller is constituted by a liner which can be installed in the housing. In an advantageous further development of the device according to the invention it is possible to provide for the end wall of the liner towards the removable portion to be the sole radial contact surface of this removable portion on the remainder of the housing.

It has further proven to be advantageous if a contact-less labyrinth seal located radially outward between the housing and the removable portion of the housing follows the liner. An advantageous design of the labyrinth seal is achieved by a first ring-shaped end surface of the housing adjoining the liner and extending in axial direction for a shorter distance in the direction of the removable portion of the housing than of the liner and second ring-shaped end surface following this recessed first ring-shaped end surface which is located at a greater radial distance from the liner and extends in axial direction beyond the liner, as well as by a ring-shaped recess provided in the removable portion of the housing for contact-less seating of the second ring-shaped end surface of the housing.

In order to create advantageous conditions for the feeding of this back-fed air current into the fiber feeding channel, provisions are made in a further advantageous embodiment of the object of the invention for the inlet opening of the fiber feeding channel to have a width that is as large as the distance between the two end walls of the housing. Alternatively it is possible for the distance between the end walls of the housing to decrease from the width which it has in its area containing the opener roller to the inlet opening of the fiber feeding channel until it has the width of the latter.

The object of the invention effectively and simply and in an energy-saving manner prevents fly from clogging the area of the feeding device inside as well as outside the opener roller housing. This is due to the fact that the short fibers and fiber fragments detached from the opener roller within the opener roller housing which are prevented from continued circling by the fiber tuft extending towards the opener roller are brought back into the normal fiber conveying path and cannot collect in the area of the feeding device nor leave the opener roller housing at that point. This reduces the number of yarn breakages since by avoiding the accumulation of fibers the latter cannot become detached and reach the spinning element in form of fiber clots.

The invention is explained in further detail below through examples of embodiments particularly illustrated in the figures.

DETAILED DESCRIPTION OF THE PREFERRED EMBODIMENTS

Figure 2:
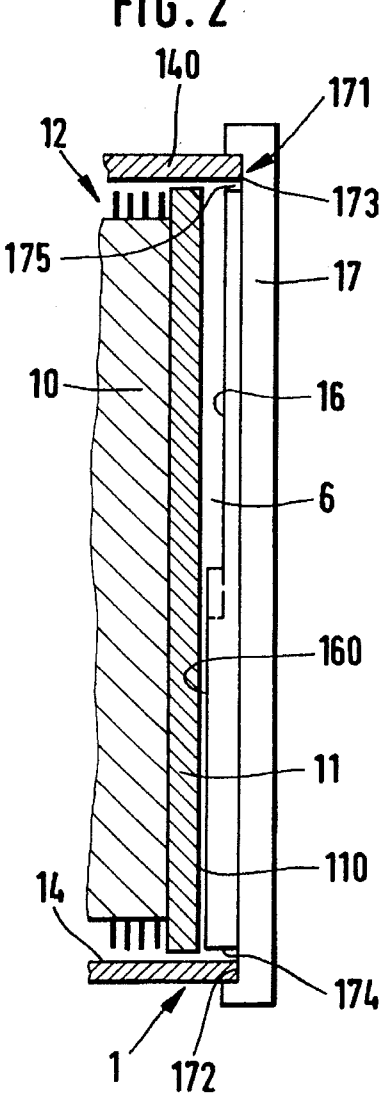
FIG. 2 shows a detail of the opener roller housing according to the invention as shown in FIG. 1, in a cross-section.

Reference will now be made in detail to the presently preferred embodiments of the invention, one or more examples of which are illustrated in the drawings. Each example is provided by way of explanation of the invention, and not as a limitation of the invention. In fact, it will be apparent to those skilled in the art that various modifications and variations can be made in the present invention without departing from the scope or spirit of the invention.

Figure 1:
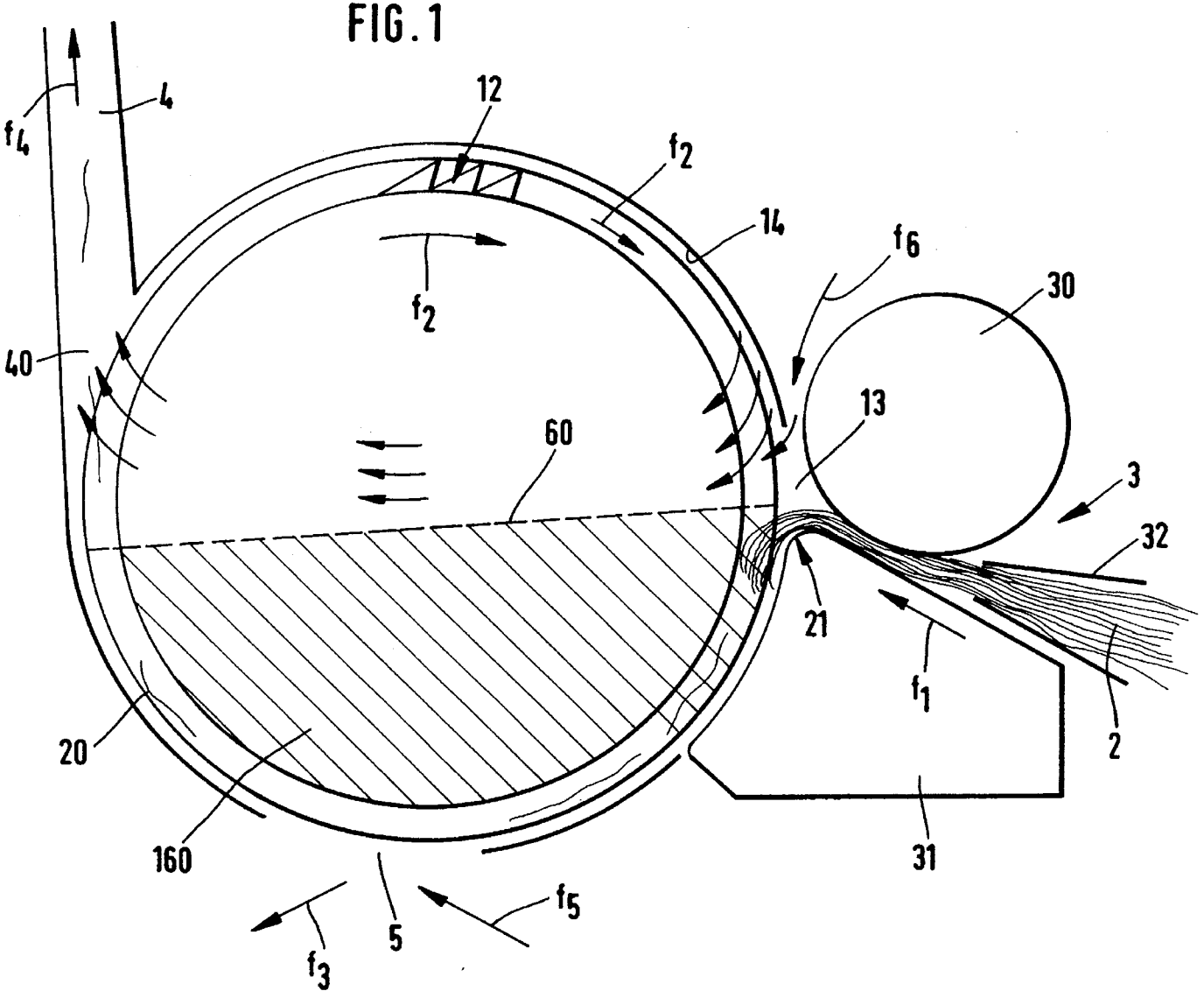
FIG. 1 shows an opener roller housing designed according to the invention, in a side view and cut-away.

FIG. 1 schematically shows an opener roller housing 1 with an opener roller 10. The latter is equipped with a circumferential surface provided with a clothing 12 located between two end disks 11 (FIG. 2) which may be integral parts of the opener roller 10.

Fiber material in the form of a fiber sliver 2 is fed to the opener roller 10 in the direction of arrow $f_1$ by means of a feeding device 3. The feeding device 3 is equipped with a delivery roller 30, with a feeding trough 31 interacting elastically with the former as well as with a feeding funnel 32. The feeding device 3 is associated with an opening 13 in the circumferential wall 14 of the opener roller housing 1 into which it extends at least in part.

To make the interior of the opener roller housing accessible, one of the two end walls 15 and 16 (see FIGS. 6 and 7), e.g. end wall 16, is designed to be a removable part (lid 17 or cover).

The opener roller 10 rotates during operation in the direction of arrow f2 and thereby conveys the fibers 20 removed from the leading end of the fiber sliver 2 into a fiber feeding channel 4 through which the fibers 20 are fed by means of a conveying air current to an open-end spinning element which is not shown.

In the direction of fiber movement (arrow $f_2$), a dirt collection opening 5 is provided in the shown embodiment between the feeding device 3 and the fiber feeding channel 4 in the circumferential wall 14 of the housing 1 through which dirt particles detached from the fibers 20 can be eliminated (see arrow $f_3$).

Negative pressure is present in the not-shown open-end spinning element, causing air to be sucked through the fiber feeding channel 4. This is shown by arrow $f_4$. The greater part of this air is sucked through the dirt collection device 5 (see arrow $f_5$). A smaller portion of air is sucked through opening 13 in the opener roller housing 1 (arrow $f_6$).

Before explaining in greater detail how the air sucked through the opening 13 into the opener roller housing 1 reaches the fiber feeding channel 4, the configuration of the housing 1 in the direction of rotation of the opener roller 10 (see arrow $f_2$) after entry into the fiber feeding channel 4 shall be explained. In the area between the inlet opening 40 of the fiber feeding channel 4 and the opening 13 which contains the feeding device 3 at least in part, at least one of the end walls 15 and 16 of housing 1, e.g. the end wall 16 formed by the lid 17, constitutes an air duct 6. According to FIGS. 1 and 2, this air duct 6 is formed in that the distance between the end walls 15 and/or 16 of the housing 1 on the one hand and the end walls 110 and/or 111 of the opener roller 10 (see FIGS. 2, 6 and 7) is enlarged as compared to the area 160 which does not serve as an air duct 6. This air duct 6 extends from the opening 13, which contains the feeding device 3 at least in part, to the area of the inlet opening 40 of the fiber feeding channel 4. In the area 160 which does not serve as air duct 6, a shorter distance is kept between the end walls 110 and/or 111 of the opener roller 10 and the end walls 15 and/or 16 of the housing 1 than in the area of air duct 6. This shorter distance is located on the fiber-conveying side of the housing 1, between the opening 13 which contains the feeding device 3 at least partially and the inlet opening 40 of the fiber feeding channel 4.

In the embodiments shown in FIGS. 1 and 2, the air duct 6 is separated from the circumferential area of the opener roller 10 - as seen in the direction of fiber movement (arrow $f_2$) - between the inlet opening 40 of the fiber feeding channel 4 and the opening 13 which contains the feeding device 3 at least partially, in that the air duct 6 is separated by a suitable delimitation wall 60 from the area 160 which does not serve as an air duct. Here the end of the delimitation wall 60 towards the opening 13 - as seen in the direction of fiber movement indicated by an arrow $f_2$ - is located in the vicinity of this opening 13, but before the feeding point 21 of the fiber sliver 2.

As the opener roller 10 rotates in the opener roller housing 1, a circulating current is created. Part of the latter emerges, as mentioned, through the fiber feeding channel 4 and at the same time carries the fibers 20 along which have become detached in the meantime from the clothing 12 of the opener roller 10. There are however fibers 20 and fiber fragments which have not been able to detach themselves from the clothing 12 for some reason - possibly because they were embedded more deeply in the clothing than the fibers 20 which entered the fiber feeding channel 4 - and continue to be transported between the teeth of the clothing 12 in the direction of the feeding device 3. At this point (feeding point 21) the leading end of the fiber sliver 2 extends in the form of a fiber tuft into the area between the clothing teeth and thus shuts off the path for the air current circling together with the opener roller 10. The air now attempts to escape from housing 1 through the gap remaining between the delivery roller 30 and the circumferential wall 14 of the housing 1.

With the recessed portion of the end wall 16 of lid 17, said lid 17 constitutes the above-mentioned air duct 6 through which the air circling together with the clothing 12 of the opener roller 10, i.e. the excess pumping air, is enabled to return between the end wall 16 of lid 17 and end wall 110 of the opener roller 10 from the area near the opening 13 to the area of the inlet opening 40 of the fiber feeding channel 4. The ventilation action of the air current flowing between the end walls 110 or 111 of the opener roller 10 and the end walls 15 or 16 of housing 1 causes the air to be forced from the circumference of the opener roller 10 to the side. This air which is fed back to the inlet opening 40 of the fiber feeding channel 4 has the possibility, thanks to the air current building up in the air duct 6 from the inlet opening 40 of the fiber feeding channel 4 to the opening 13, to follow the suction effect in a lateral direction relative to the opener roller 10 and to enter the air duct 6 for the above-mentioned back-feeding. Not only is escape of air from housing 1 through opening 13 prevented thereby, but the fibers 20 which were previously unable to leave the housing 1 through the fiber feeding channel 4, and may in the meantime have become detached from the clothing of the opener roller 10, now have the possibility of being fed back to the fiber feeding channel 4 by the air current going through the air duct 6. In order to obtain the described function, the air duct is sized so that the major portion of the "pumping air" leaves the housing 1 together with the fiber stream as soon as the inlet opening 40 of the fiber feeding channel 4 is reached, but so that as the opener roller 10 continues to rotate, the air it slaves is given the opportunity to return to the inlet opening 40 of the fiber feeding channel 4 before reaching the location at which the fiber sliver 2 is being fed to the opener roller 10 (feeding point 21). In this process, it carries along the fibers 20 which, although they were unable to detach themselves from the clothing 12 of the opener roller 10 before reaching the inlet opening 40 of the fiber feeding channel 4, have nevertheless left the clothing 12 in the meantime. Thereby overpressure is avoided in the vicinity of opening 13 so that an escape of air (and fibers) is avoided.

Figure 6:
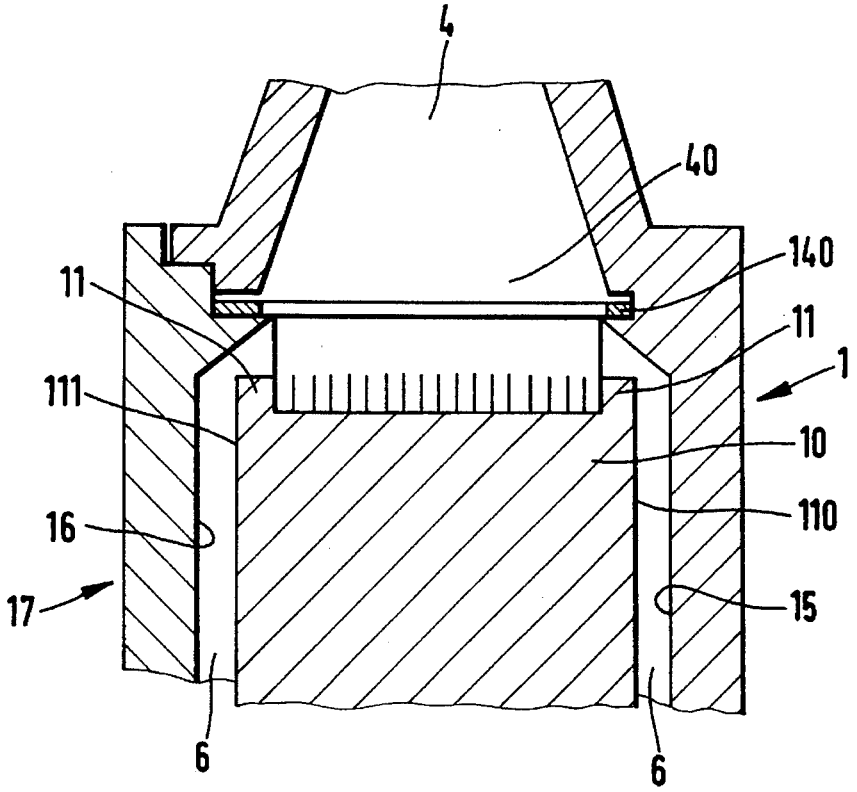
FIG. 6 shows a cross-section of part of a modified opener roller housing according to the invention.
Figure 7:
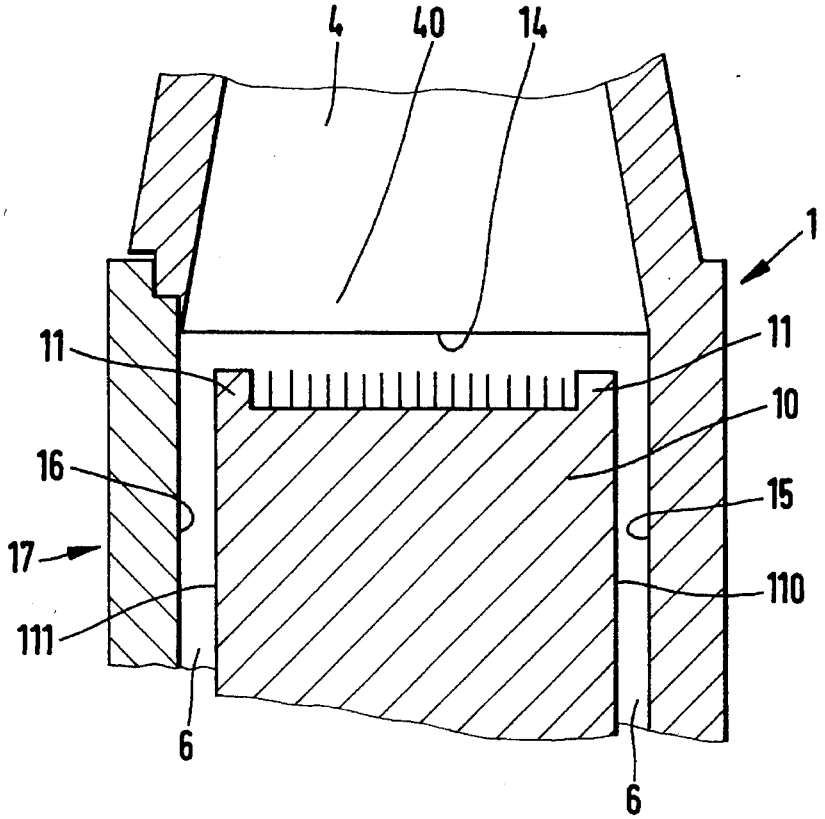
FIG. 7 shows a cross-section of part of the opener roller housing according to another modification according to the invention.

As FIGS. 6 and 7 show through the symmetric drawing of the opener roller housing 1, such an air duct 6 can be provided on both sides of the opener roller 10. However, one air duct 6 on only one side of the opener roller 10 is sufficient. In principle the air duct can be optionally located between the end wall 110 of the opener roller 10 and the end wall 15 of housing 1 or else between the end wall 111 of the opener roller 10 and the end wall 16 of housing 1. Especially if a liner 140 in the form of a pot (see FIGS. 2 and 4) is provided for the housing 1 as a wear protection - in which the technically required openings, e.g. opening 13, dirt collection opening 5 and inlet opening 40 of the fiber feeding channel 4 are provided - it is especially advantageous for the air duct 6 not to be placed randomly on any side of the opener roller 10, but preferably in the removable portion of the opener roller housing 1, i.e. in its lid 17.

The configuration of the liner 140 is in principal unimportant. Thus for instance, it may be given the shape of a pot, of a closed or open ring, possibly consisting of separate segments. In principle it is however important for the liner 140 to be designed so that no fibers 20 may be caught and settle on it. An example of such an embodiment will be described in more detail further below with respect to the seal.

Figure 4:
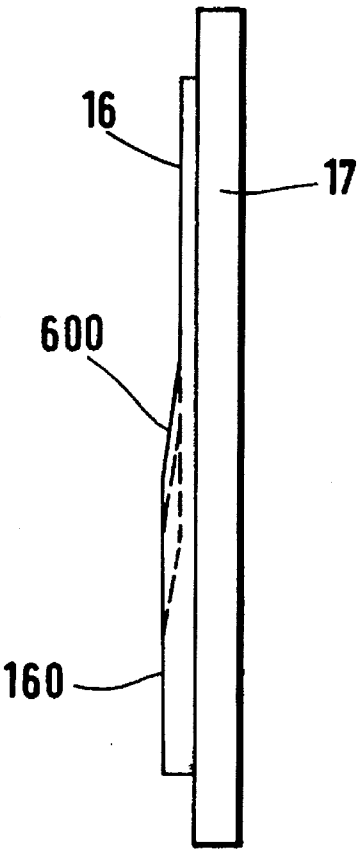
FIG. 4 shows a side view of the cover shown in FIG. 3.

Different designs are possible for the delimitation wall 60 which separates the air duct 6 from the area 160 of the end wall 16 not serving as air duct 6. According to FIG. 1 it is designed so that it forms an abrupt step to the area 160 of the lid 17 which does not serve as air duct 6. However this is not a pre-condition for the described device. FIG. 4 shows a variation in which the air duct 6 is provided with a delimiting wall 600 which gradually verges into that area 160 of the end wall 16 of housing 1 which does not serve as an air duct. A better air duct is achieved by such a gradual passage from the air duct 6 into the area 160 which does not serve as an air duct. This is also advantageous for the return transportation of the fibers to the inlet opening 40 of the fiber feeding channel 4.

Figure 3:
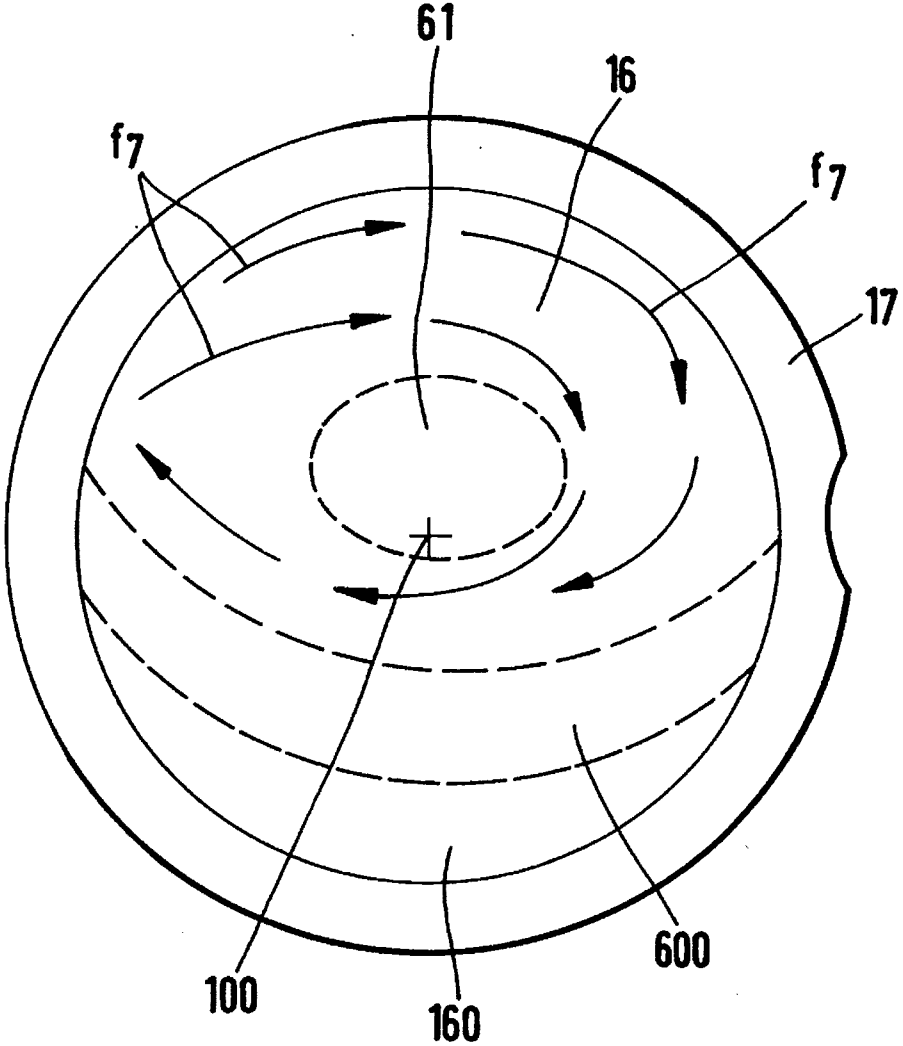
FIG. 3 shows a cover of the opener roller housing in a top view.

FIG. 3 shows a lid 17 with such a delimiting wall 600 which in this embodiment not only constitutes a gradual passage from the air duct 6 into the area 160 of the end wall 16 which does not serve as air duct, but in addition is shaped in the form of an arc in such a manner as to be concave - in relation to axis 100 of opener roller 10 - and is located on the side of end wall 16 of housing 1 on which the lid portion not serving as air duct 6 (area 160) is located. This makes it possible for an air eddy to be produced which has its exit in the area between the clothing 12 of the opener roller 10 and the circumferential wall 14 of the housing 1 and which then enters the area of air duct 6 in the form of a spiral and is deflected in such a manner that the air current is again fed to the inlet opening 40 of the fiber feeding channel 4. The result of this is that the air - and with it the fibers 20 and the fiber fragments as well as the dirt particles it conveys - does not reach the area of opening 13 at first, but is fed back for a major part even earlier into the air duct 6 going to the inlet opening 40 of the fiber feeding channel 4.

Such pneumatic conveying is especially advantageous since the air current need overcome only minimal resistances. The air current is conveyed in the area of lid 17 above axle 100 of the opener roller 10 - shown in FIG. 3 - and also in the direction of rotation of the opener roller 10 as in the lower area of the air duct 6, delimited by the delimiting wall 600. Thus the air current thus has a motional component that is common to the opener roller 10 as well as to the air current in the upper as well as in the lower area of lid 17, i.e. while it is being fed back to the inlet opening 40 of the fiber feeding channel 4.

Figure 5:
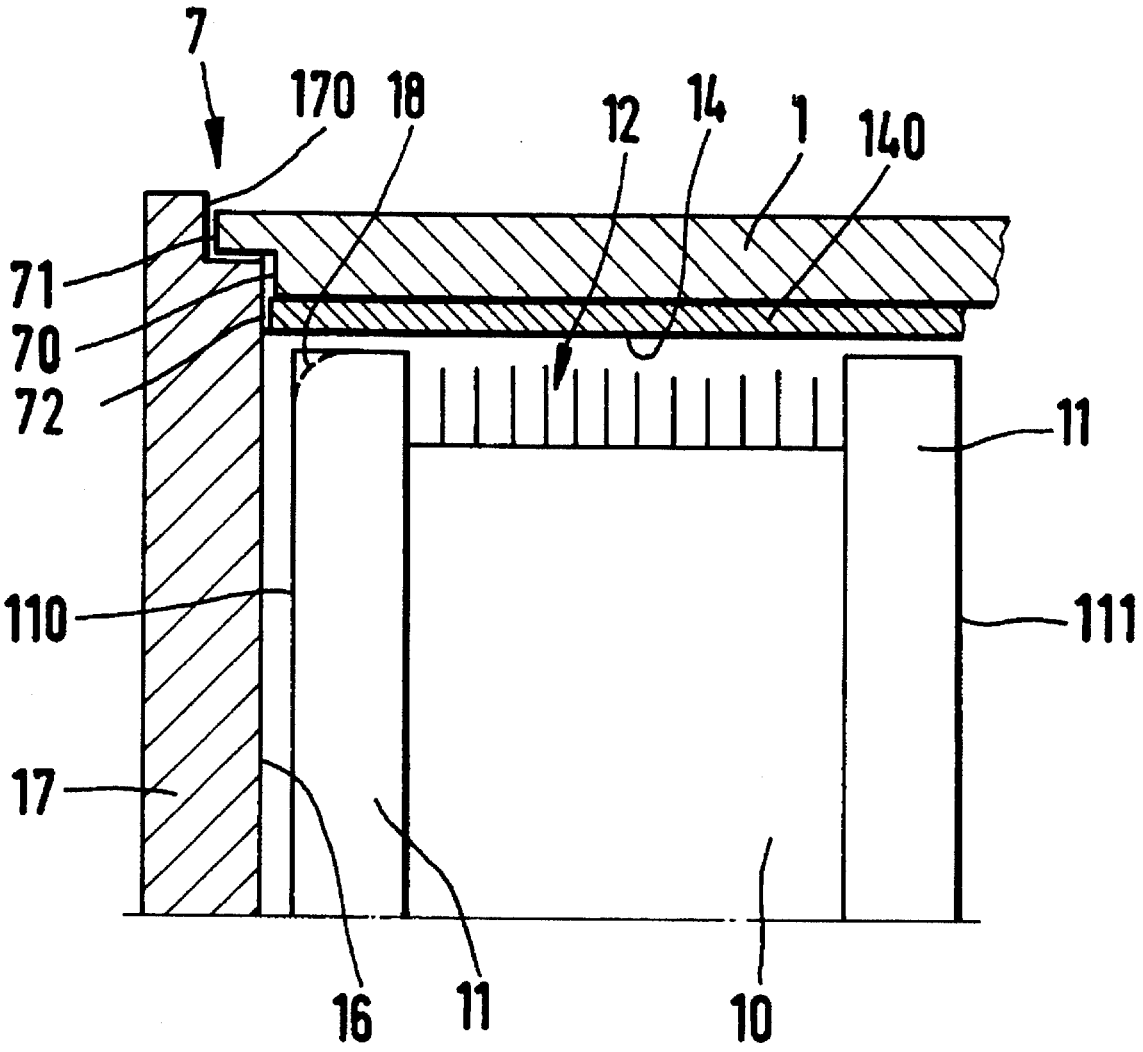
FIG. 5 shows a cross-section through part of a modified opener roller housing.

It appears from the above description that the air - and with it the fibers 20, fiber fragments and dirt particles which it transports - must be deflected sideways from the area between the clothing 12 of the opener roller 10 and the circumferential wall 14 of housing 1 so that it can be fed back between the end walls 110 or 111 and 15 or 16 to the inlet opening 40 of the fiber feeding channel 4. At the same time the air must first be moved in the axial direction - relative to the opener roller 10 - and later essentially in radial direction to the opener roller 10. In order to facilitate this change of direction of the air current, provisions are made according to FIG. 5 for the opener roller 10 not to simply pass suddenly from its circumferential surface into its radial surface (end wall 110 or 111), but for this passage to take place in an attenuated manner. For this reason, as shown in FIG. 5, a ring-shaped transition surface which lies neither in the circumferential surface nor in the plane constituted by end wall 110 or 111 is provided between the circumferential surface of the opener roller 10 and its radial surface. This is achieved by chamfering the edge of the ring. Instead of a chamfer, it is also possible to provide a convex ring surface 18, i.e. one which curves to the outside (FIG. 5).

The above description shows that the process as well as the device according to the invention can be varied in many ways, e.g. by replacing individual characteristics by equivalents or by combining these in different manners.

In the shown embodiments, the air duct 6 is not separated from the space surrounding the opener roller 10 on its side away from the fiber conveying area, i.e. area 160 which does not serve as an air duct, i.e. the air duct 6 verges directly into the space surrounding the circumferential surface of the opener roller 10 on its side away from the area 160 which does not serve as an air duct. This, however, is not a pre-condition for the device according to the invention. Thus it is absolutely possible to provide a kind of "hub" 61 in the end wall 16 - and possibly also in end wall 15 - around which the air current is taken in the form of an eddy (see broken-line drawing in FIG. 3). The purpose here is for the air current which first of all circles together with the clothing 12 of the opener roller 10 to enter the area of air duct 6 after being removed towards the end wall 16 and/or 15 in such manner that it is again fed back to the inlet opening 40 of the fiber feeding channel 4 on the other side of this "hub" 61 (not shown).

As has been mentioned several times above, it is necessary to return the back-fed air to the fiber feeding channel 4 past which this air was previously conveyed. In order to achieve this, the air must have the possibility of entering the inlet opening 40 of the fiber feeding channel 4 without overcoming great resistances. For this purpose provisions are made according to FIG. 6 for the fiber feeding channel 4 to have a width in the area of its inlet opening 40 that is equal to the width of housing 1 at that location. This is achieved in that the housing 1 narrows in the area verging into the inlet opening 40 of the fiber feeding channel 4 from the width which it has in its area containing the opener roller 10 to the required width, i.e. the width of the inlet opening 40 of the fiber feeding channel 4 at this location. In order to prevent fibers 20 from being caught or dammed up, the width of the housing interior is as a rule even slightly less than the width of the inlet opening 40 of the fiber feeding channel 4.

Alternatively and for the same purpose, the inlet opening 40 of the fiber feeding channel may have a width from the very start which is equal to the distance between the two end walls 15 and 16 of housing 1.

While the air moves from the circumferential area of the opener roller 10 into its lateral area, the danger exists that fibers 20 may enter into gaps that may be present there and may settle therein. This is avoided according to the embodiment shown in FIG. 5 in that the removable part (lid 17) does not extend into housing 1 but rather presses sealingly against the end surface 72 of housing 1 which is closest to the opener roller 10. The end surface 72 in this embodiment is the end wall adjoining the circumferential wall 14 of housing 1 towards the opener roller 10. Such a seal of housing 1 is of basic importance and can be used even when no air duct 6 and therefore no back-feeding of air to the fiber feeding channel 4 is provided.

If the circumferential wall 14 of the housing towards the opener roller is constituted by a liner 140 which can be installed in the housing, this liner 140 extends according to FIG. 5 beyond the end walls or end surfaces towards the lid 17 so that the lid 17 alone is pressed against the liner 140, i.e. so that the end surface 72 constitutes the sole radial contact surface between the lid 17 and the housing 1. If the lid 17 is provided with a stepped offset outer rim, the housing 1, in its area towards the lid 17, can also be offset in steps in its contour, however without coming into contact with the cover 17. In any case it must be ensured that the lid 17 only comes into contact with the end surface of the liner 140 which is towards said lid 17.

It is advantageous here if additional measures are taken in the area between lid 17 and housing 1 to exclude currents of secondary air. For this reason the area between lid 17 and housing 1 is made in the form of a contact-less labyrinth seal radially outside the liner 140. Here there are several basically different possibilities. According to the embodiment shown in FIG. 5, the labyrinth seal 7 is provided outside the end surface 72 constituted by the liner a first ring-shaped end surface 70 of housing 1 which extends for a shorter distance towards lid 17 - relative to the opener roller 10 - than the liner 140. This first ring-shaped end surface of the housing 1 is followed by a second ring-shaped surface 71 which is at a further radial distance from the liner 140 and which extends in axial direction beyond the liner 140 and thus also beyond the first ring-shaped end surface 70. This second end surface extends into a recess of the lid 17 which contains the second ring-shaped end surface 71 without contact.

Another embodiment of the seal of housing 1 is shown in FIG. 2. The removable part of housing 1, i.e. the lid 17, in this embodiment is provided with a ring-shaped recess 171 (ring-shaped groove). The latter is provided with a ring-shaped radial surface 172 as its bottom and is delimited on the radially outward side by a first ringed surface 173 serving as a centering surface and surrounding a corresponding ring land of housing 1, as well as by a second ringed surface 174 on the radially inward side. The radial surface 172 of the ring-shaped recess 171 in lid 17 is made in the form of a sealing contact surface for the end surface 72 of housing 1, and when a pot-shaped or ring-shaped liner 140 according to FIGS. 2 and 5 is provided, this end surface 72 is part of the liner 140. If no such liner 140 is provided, the end surface 72 may also,be an integral part of housing 1 in form of a ring-shaped ridge. In any case the end surface 72 must adjoin the circumferential wall 14 of housing 1. In that case this ring land or the liner 140 extend as far as the ringed surface 173. This liner 140 - or this ring land, even if it is not its end wall 72 which reaches as far as the ringed surface 173 - interacts with the ringed surface 173 which centers thereby the liner 140 and also the lid 17. The other ringed surface 174 which follows the radial surface 172 and extends radially inward is on the other hand at a distance from the circumferential wall 14 constituted by the liner 140 or the actual housing 1 itself, so that a gap 175 is produced between the ringed surface 174 and the circumferential wall 14.

In order to prevent any fibers 20 from becoming caught at that location, the gap 175 may not be too narrow. For this reason its width, i.e. the distance between the ringed surface 174 and the circumferential wall 14 is greater than the cross-section of the fibers 20 to be spun. For safety reasons a dimension equal to a multiple of the cross-section of the fibers 20 is selected for this. This is generally the case if the width of gap 175 measures between 0.2 and 0.3 mm and possibly even somewhat more.

It will be apparent to those skilled in the art that various modifications and variations can be made in the present invention without departing from the scope and spirit of the invention. For example, features illustrated or described as part of one embodiment can be used on another embodiment to yield a still further embodiment. It is intendêd that the present invention cover such modifications and variations as come within the scope of the appended claims and their equivalents.

I claim:

1. A process for pneumatic feeding of fibers to a fiber collection surface of an open-end spinning element from an opener roller rotating within a housing, said process comprising the steps of:

feeding a fiber sliver from a feeding point to the opener roller and opening the sliver into individual fibers, and conveying the individual fibers in a circulating airstream in a circumferential space between the opener roller and the housing from the feeding point to an inlet of a fiber feeding channel in the rotational direction of the opener roller, the fiber feeding channel disposed to receive the fibers from the circulating airstream and convey the fibers to the open-end spinning element;

directing the circulating airstream from the inlet of the fiber feeding channel to the area of the fiber sliver feeding point in the rotational direction of the opener roller;

at a circumferential location between said fiber feeding channel and said fiber sliver feeding point in the direction of rotation of the opener roller, directing the circulating airstream longitudinally along the opener roller with respect to a rotational axis of the opener roller to at least one end wall of the opener roller; and backfeeding the circulating airstream from the end wall of the opener roller to the inlet area of the fiber feeding channel, wherein any fibers remaining in the circulating airstream which were not initially passed into the fiber feeding channel are drawn back to the fiber feeding channel.

2. The process as in claim 1, wherein said backfeeding along the end wall of the opener roller includes backfeeding the circulating airstream to an area of the inlet of the fiber feeding channel so that said backfed airstream merges and has a common rotational component with the circulating airstream from the fiber sliver feeding point.

3. An apparatus for pneumatic feeding of fibers to a fiber collection surface of an open-end spinning element, said device comprising:

an opener roller rotatably disposed within an opener roller housing, said opener roller having a clothing around the circumference thereof between opposite end walls, said housing having a circumferential wall surrounding said opener roller with a circumferential space therebetween and end walls oppositely facing said opener roller end walls, said opener roller housing further comprising a sliver feeding opening defined therein;

a feeding device configured to feed a fiber sliver to said opener roller through said sliver feeding opening;

a fiber feeding channel defined in said opener roller housing for conveying fibers to an open-end spinning element, said fiber feeding channel comprising an inlet defined in said circumferential wall and configured to receive individual fibers conveyed thereto from said sliver feeding opening in an airstream circulating in said circumferential space;

an air duct defined between at least one of said opener roller end walls and said respective opener roller housing end walls, said air duct in pneumatic communication with said circulating airstream space at a location generally adjacent said sliver feeding opening and said fiber feeding channel inlet, said air duct comprising an enlarged space defined between a portion of said opener roller end wall and said opener roller housing end wall; and wherein air circulating in said circumferential space with said opener roller is conveyed past said fiber feeding channel inlet in the rotational direction of said opener roller to generally said sliver feeding opening, the airstream then being backfed longitudinally with respect to a rotational axis of said opener roller along said opener roller from said sliver feeding opening to said air duct, and along said air duct to generally said fiber feeding channel inlet so that any fibers remaining in said circulating airstream are backfed to said fiber feeding channel inlet by way of said air duct.

4. The apparatus as in claim 3, wherein said opener roller housing comprises a removable end wall, said air duct defined by said removable end wall.

5. The apparatus as in claim 3, wherein said air duct comprises a recessed portion defined in at least one of said housing end walls and further comprises a delimination wall merging from said recessed portion.

6. The apparatus as in claim 5, wherein said delimination wall is concave with respect to the axis of said opener roller axis.

7. The apparatus as in claim 3, wherein said air duct is in communication with said fiber feeding channel inlet at a location before said fiber feeding channel inlet in the rotational direction of said opener roller so that said backfed airstream merges and has a common rotational component with said circulating airstream at a point before said fiber feeding channel inlet.

8. The apparatus as in claim 3, wherein said opener roller further comprises a ring-shaped radial transition surface defined at the position wherein said circumferential surface of said opener roller meets said end wall of said opener roller, said transition surface aiding in establishing said backfed airstream.

9. The apparatus as in claim 8, wherein said transition surface comprises a convexly curved ringed surface.

10. An apparatus for pneumatic feeding of fibers to a fiber collection surface of an open-end spinning element, said device comprising:

an opener roller housing comprising a circumferential wall between opposite end walls, said housing further comprising a feeding device opening and a fiber feeding channel inlet defined in said circumferential wall.

an opener roller comprising a circumferential surface with a clothing between opposite end walls, said opener roller rotatably disposed within said housing with a space between said opener roller end walls and said housing end walls and a circumferential space between said housing circumferential wall and said opener roller circumferential surface, wherein a circulating airstream is established within said circumferential space which conveys fibers from said feeding device opening to said fiber feeding channel inlet in the direction of rotation of said opener roller, said airstream continuing to circulate past said fiber feeding channel inlet towards said feeding device opening, and wherein a backfeeding airstream is established from said feeding device opening longitudinally along said opener roller with respect to a rotational axis of said opener roller to said space between said opener roller end walls and said housing end walls, and then to said fiber feeding channel inlet; and a removable lid member configured in said housing, said lid member defining one of said housing end walls, said lid member sealingly engaging with said circumferential wall of said housing.

11. The apparatus as in claim 10, wherein said lid member comprises a ring-shaped recess having a radial sealing surface for engaging with an end surface of said housing circumferential wall and a circumferential ringed surface for engaging with an outer surface of said housing circumferential wall adjacent said end surface, said lid member further comprising a radial ring surface radially inward from said recess so that a gap is defined between said radial ring and an inner surface of said housing circumferential wall.

12. The apparatus as in claim 11, wherein said gap is in the range of 0.2 to 0.3 mm.

13. The apparatus as in claim 10, wherein said housing comprising a liner, said liner defining an inner circumferential surface facing said opener roller.

14. The apparatus as in claim 13, wherein said liner comprises an end surface which sealingly engages said lid member.

15. The apparatus as in claim 14, further comprising a contact-less labyrinth seal defined between said liner and said lid member.

16. The apparatus as in claim 10, wherein said fiber feeding channel has a width essentially equal to the distance between said housing end walls.

17. The apparatus as in claim 10, wherein the distance between said housing end walls decreases from the area adjacent said opener roller end walls towards the fiber feeding channel inlet opening.

* * * * *